United States Patent [19]

Mallard

[11] 4,243,076

[45] Jan. 6, 1981

[54] LOOM RAPIER DRIVE MECHANISM

[76] Inventor: Robert G. Mallard, 390 S. Main St., Hopedale, Mass. 01747

[21] Appl. No.: 913,875

[22] Filed: Jun. 8, 1978

Related U.S. Application Data

[62] Division of Ser. No. 756,020, Jan. 3, 1977, Pat. No. 4,111,240.

[51] Int. Cl.[3] ..... D03D 47/18

[52] U.S. Cl. ..... 139/449

[58] Field of Search ..... 139/440, 443, 446, 449

[56] References Cited

U.S. PATENT DOCUMENTS

| | | | |
|---|---|---|---|
| 6,301 | 2/1875 | Gee | 139/440 |
| 2,066,532 | 1/1937 | Kellogg et al. | 139/449 |
| 3,734,144 | 5/1973 | Remond | 139/449 |
| 3,884,275 | 5/1975 | Camprubi | 139/449 |
| 3,948,297 | 4/1976 | Doriguzzi | 139/449 |
| 4,071,056 | 1/1978 | Camprubi | 139/449 |
| 4,111,240 | 9/1978 | Mallard | 139/449 |

*Primary Examiner*—Henry Jaudon

*Attorney, Agent, or Firm*—Norman S. Blodgett; Gerry A. Blodgett

[57] ABSTRACT

Drive mechanism for a rapier-type loom, including a timing belt to which the rapiers are attached and an operating means, including a dwell device, for reciprocating the belt.

5 Claims, 6 Drawing Figures

LOOM RAPIER DRIVE MECHANISM

This is a division of application Ser. No. 756,020 filed Jan. 3, 1977 now U.S. Pat. No. 4,111,240.

BACKGROUND OF THE INVENTION

In the development of textile looms, one deterent to operating looms at higher speed has always been the fact that the weft had to be carried back and forth by a flying shuttle. The mass of this shuttle must be accelerated to high speed as it passes from one side of the loom to the other and decelerated at the other end, after which it must be re-accelerated and decelerated again in returning to its original position. This has definitely inhibited higher speed looms. Once the mass of the shuttle has been reduced to as low a value as is practical, the only way that the shuttle passage through the loom shed can be speeded up is by imparting larger amounts of energy to it at the end of its travel. In the conventional flying shuttle loom, this energy has been imparted by the picker stick. The more energy the picker stick imparts to the shuttle the greater the noise; various government agencies have not only restricted the amount of noise that can exist in a loom room of a textile factory, but have taken positive steps to reduce the noise. Since speeding up the loom has been definitely limited in this way, because of noise and other factors, such as wear on the equipment, other methods of transferring the weft back and forth through the shed have been seriously considered. One method of weft transfer that thas had some success is the use of thin, cantilevered rods or rapiers which move halfway across the shed and transfer the weft end in the middle of the loom. However, the mechanism for producing rapier action is quite intricate and expensive, so that many mill owners would prefer to operate with their old, slow-operating looms rather than convert to the expensive high-speed rapier looms. Another factor holding up the introduction of the rapier-type loom has been fact that the intricate mechanism necessary to drive the repiers tends to wear out; the replacement parts are expensive and there is also a degree of expensive down-time while the repair is being made. These and other difficulties experienced with the prior art devices have been obviated in a novel manner by the present invention.

It is, therefore, an outstanding object of the invention to provide a drive mechanism for rapier-type looms, which mechanism is simple in construction, inexpensive to manufacture, and is capable of a long life of useful service with a minimum of maintenance.

Another object of this invention is the provision of a drive mechanism that can be used to convert a conventional flying-shuttle loom to a rapier-type loom.

A further object of the present invention is the provision of a drive mechanism for a rapier-type loom in which the major parts that are subject to wear are readily replaceable.

It is another object of the instant invention to provide a drive mechanism for a loom of the rapier-type in which each part is simple and inexpensive and in which each part can be easily replaced without complete disassembly of the mechanism.

A still further object of the invention is the provision of a drive mechanism for a rapier-type loom which is low in power consumption.

It is a further object of the invention to provide a drive mechanism for the rapiers of a shuttleless loom in which an increased fabric width is possible for a given loom width.

A further object of the invention is the provision of a single drive unit for a double rapier system which balances out many of the inertia forces at reversal.

Another object of the invention is the provision of a loom with a single drive, double rapier system in which is eliminated any lost motion overide at reversal where the pick-up and yarn transfers occur.

It is a still further object of the present invention to provide a drive mechanism for a rapier-type shuttleless loom, which mechanism introduces a dwell in the rapier movement at the outer limits of rapier path, during which dwell both the heddle action and the weft gripper action can take place in a leisurely manner.

Another object of the invention is the provision of a loom which is relatively free of noise and shock at all times during the weaving cycle, so that it operates not only with less noise and less wear on the parts, but the fabric generated is of better quality.

Another object of the invention is the provision of a shuttleless loom having reciprocating rapiers for transferring the weft, wherein the rapiers do not move continuously, but remain in a fixed position just outside of the web for a portion of the weaving cycle when the beat-up action takes place and the weft pickup takes place, thus resulting in a shorter weft length with better control of the weft and, therefore, better quality of cloth, as well as allowing a simpler and more reliable yarn pickup mechanism.

With these and other objects in view, as will be apparent to those skilled in the art, the invention resides in the combination of parts set forth in the specification and covered by the claims appended hereto.

SUMMARY OF THE INVENTION

In general, the invention consists of a rapier drive mechanism for a textile loom having a pair of transversely-slidable rapiers capable of movement for transferring the weft yarn from side-to-side of the loom. An endless belt is mounted in the loom and has upper and lower runs which extend horizontally across the loom, the upper run being connected to one rapier and the lower run being connected to the other rapier to produce the weft-transferring movement. Operating means is provided to bring about alternative movement of the belt in one direction to bring the rapiers toward one another and in the other direction to move the rapiers apart. The operating means also brings about a dwell in the belt and rapier movement at the point at which the rapiers have moved to their most remote position.

More specifically, the belt is formed with teeth on its inner surface and passes over an idler sprocket located at one side of the loom, as well as over a drive sprocket at the other side of the loom. The operating means is connected to the drive sprocket to rotate the same. The operating means includes a rocker arm that is pivotally mounted at one end on the lay sword rocker shaft and that has a gear segment mounted at the other end. A transmission connects the gear segment to the drive sprocket and a geneva device is included for producing a dwell in the drive sprocket movement. A connection exists between the lay sword and the rocker arm to produce opposite movement of the rocker arm in response to movement of the lay sword.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
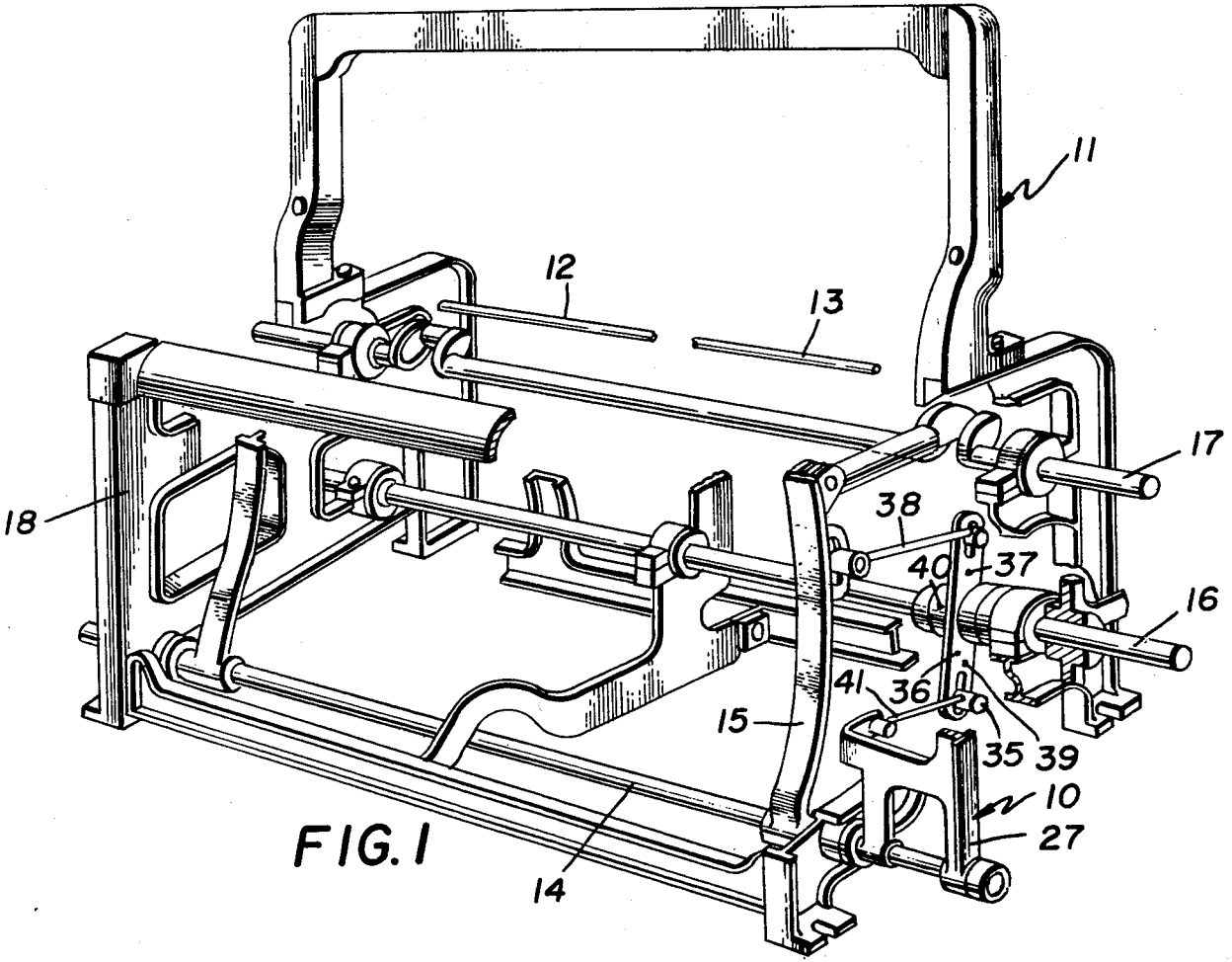
FIG. 1 is a perspective view of a textile loom incorporating the drive mechanism of the present invention.

Referring first to FIG. 1, which best shows the general features of the invention, the drive mechanism, indicated generally by the reference numeral 10, is shown in use in a textile loom 11 of the type in which the filling yarn or weft is fed transversely by a pair of rapers 12 and 13. These rapiers are slidably mounted for transverse movement to transfer the weft from side-to-side of the loom. A rocker shaft 14 is mounted in the lower portion of the loom; keyed to this shaft for rocking movement with it is a lay sword 15 which carries the lay mechanism for beating up the weft. Also mounted in the frame 18 of the loom is a bottom shaft 16 and a crank or drive shaft 17.

Figure 2:
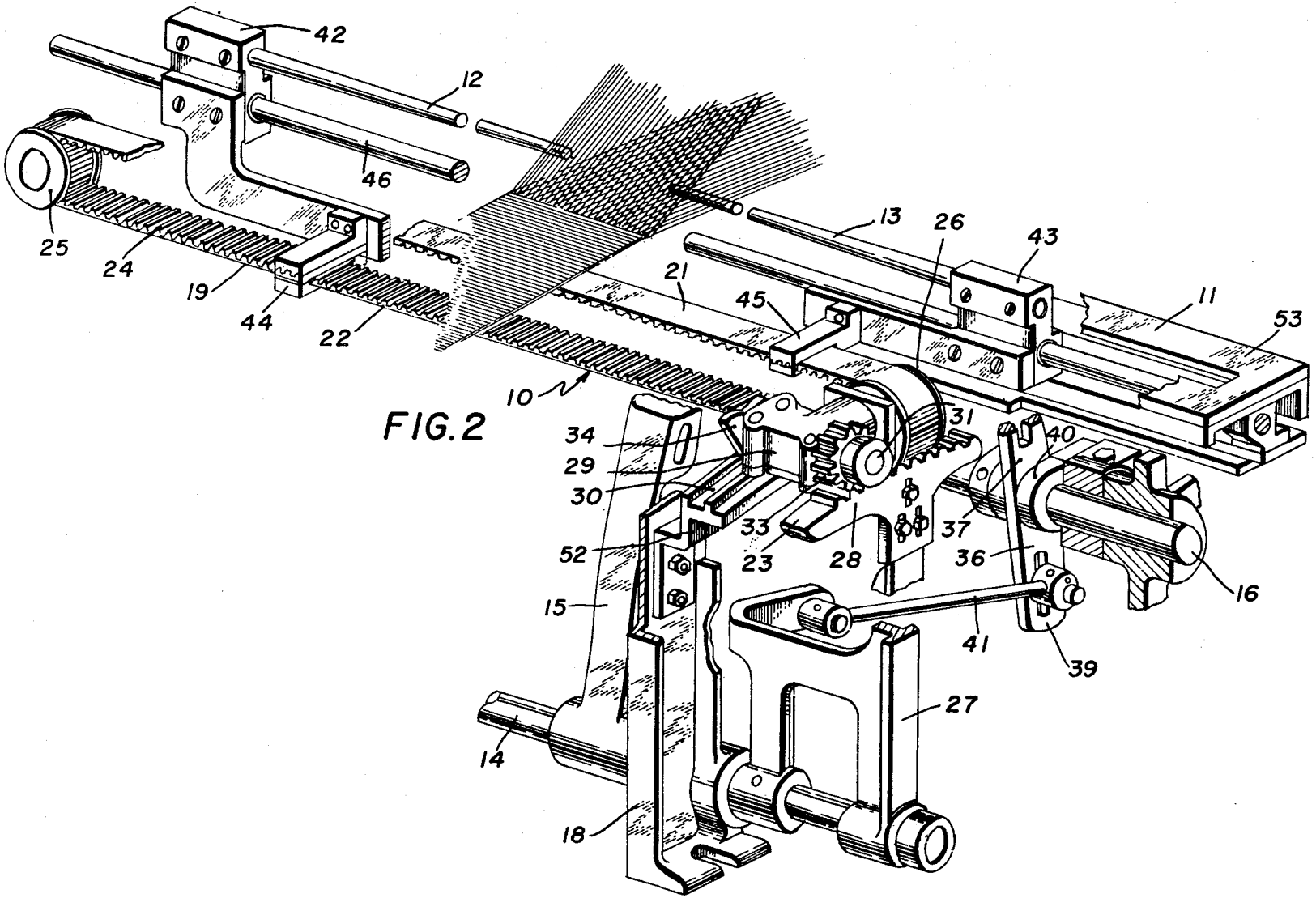
FIG. 2 is a somewhat enlarged perspective view of the drive mechanism.

Referring next to FIG. 2, it can be seen that the drive mechanism 10 is provided with an endless belt 19 having an upper run 21 and a lower run 22. The upper run 21 is connected to the rapier 13, while the lower run 22 is connected to the rappier 12. The endless belt 19 is driven by an operating means 23 to bring about alternative movement of the belt in one direction (to bring the rapiers together) and in the other direction (to move the rapiers apart). The operating means 23 also produces a hesitation or dwell in the belt and rapier movement at a time when the rapiers have moved to the position at which they are farthest apart.

The endless belt 19 is formed with gear teeth 24 on its inner surface; these teeth engage an idler sprocket 25 at one end and a drive sprocket 26 at the other end, these sprockets being located at their respective sides of the loom well outside of the fabric width. The operating means 23 is connected to the drive sprocket to rotate the same. The drive sprocket 26 is driven through a cycle that includes rotation in one direction, a dwell, and rotation in the other direction, the cycle taking place in the same period of time as a cycle of the lay. The operating means includes a rocker arm 27 which is mounted at the lower end on the lay sword rocker shaft 14 for swinging motior independently thereof and which has a gear segment 28 mounted on its upper end.

A right-angle transmission 29 is mounted to the loom lay 53 with an input shaft 31 whose axis extends transversely of the loom. It has an output shaft 32 (see FIG. 4) whose axis is aligned with the axis of the drive sprocket 26, the shaft being drivingly connected to the drive sprocket. The input shaft has a pinion gear 33 mounted on it and keyed to it, the pinion gear engaging the gear segment 28 to be driven thereby. The transmission 29 also includes a geneva device 34 that causes the output shaft 32 to dwell (and not rotate freely) even though the input shaft 33 is no longer rotated by the gear segment, because the gear segment has moved beyond the pinion.

A connection 35 joins the lay sword 15 to the said rocker arm 27 to cause opposite movement of the sword and arm relative to each other. The connection consists of a bell crank 36 pivotally mounted on the bottom shaft 16 for movement independently thereof. The bell crank has a bearing 40 rotatably mounted on the bottom shaft 16, which rotates continuously. The crank 36 has one upper portion 37 whose end is connected by a rod 38 (see FIG. 1) to the lay sword 15 and another lower portion 39 whose end is connected by a rod 41 to the rocker arm 27.

The rapier 13 is mounted on a block 43 which is slidable on a transverse rod 46 which extends across portions of the lay 53 which is swingably carried relative to the frame 18 of the loom, while the rapier 12 is mounted on a similar block 42. The block 43 has a finger 45 which extends from the block and clamps over the upper run 21 of the belt 19, while the block 42 is provided with a similar finger 44 which extends from the block and clamps the lower run 22 of the belt.

Figures 3, 4, 5, 6:
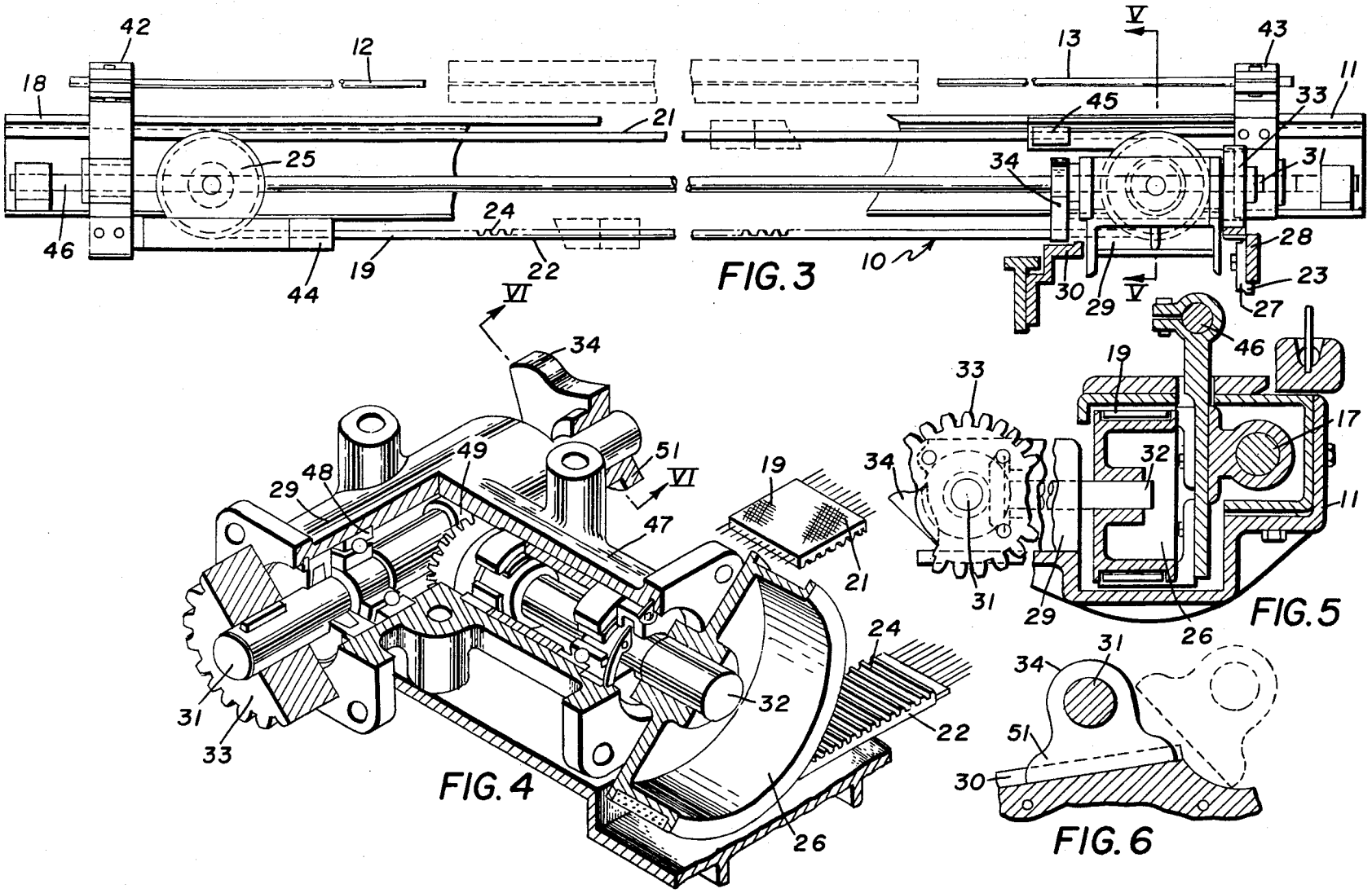
FIG. 3 is a front elevational view of the drive mechanism.
FIG. 4 is a perspective view with portions broken away of a transmission forming part of the drive mechanism.
FIG. 5 is a sectional view of the mechanism taken on the line V—V of FIG. 3.
FIG. 6 is a sectional view taken on the line VI—VI of FIG. 4.

FIGS. 4 and 5 show the details of the transmission 29. It is provided with a housing 47 which carries a ball bearing 48 which carries the input shaft 31. The input shaft in turn is carried at its other end in a similar bearing, not shown. The shaft 31 extends from the other side of the housing and carries the cam 51 of the geneva device 34 which engages a cam guide 30.

The operation and the advantages of the invention will now be readily understood in view of the above description. When the loom is set up and running, the conventional mechanisms of the loom, the crank shaft 17 thru the crank arm 27 will cause the swords 15 and attached lay 53 to reciprocate back and forth thru a limited angle. The movement of the sword 15 carries the driving rod 38 with it. The driving rod 38 moving forward moves the portion 37 of the bell crank 36 in a forward direction also which causes the bottom portion of the bell crank 39 to move rearwardly. This causes the driving rod 41 to move rearwardly and move the rocker arm 27 in a similar manner.

The lay 53 carrying the transmission 29 driving belt 19 rapiers blocks 42–45 and rapiers 12–13 is mounted to the swords 15 which are pivotally mounted to the rocker shaft 14. Also pivotally mounted to the rocker shaft 14 is the rocker 10. Lay 53 and rocker arm 27, having the same pivot point and concentric arcs of travel, can be driven in opposite directions for contact of pinion 33 and segment gear 28.

The fact that the drive rocker 10 and pinion 33 are both in motion in opposite directions reduces the effective length of the segment gear 28 necessary to give the required number of r.p.m. of the pinion to drive the rapiers their required distance. This allows segment gear to work with the loom space available without extending into operator walkway space.

Referring to FIGS. 2 and 3, the rearward movement of the rocker arm 27 moves the gear segment 28 rearwardly and this rotates the pinion gear 33 in counterclockwise direction (as viewed from the right-hand end of the loom). Referring to FIGS. 4 and 5, the rotation of the pinion gear 33 rotates the input shaft 31 of the transmission 29 and operates through gearing to drive the output shaft 32. The geneva motion 34 causes the transmission to "dwell" because of the engagement of the geneva cam 51 to the geneva cam guide 30 simultaneously with the disengagement of the pinion 33 with the segment gear 28 as the segment gear 28 is carried beyond gear mesh point by the continuous motion of the rocker arm 27 and lay 53 in their respective opposite directions. The lay 53 moves to the front center position and the rocker arm goes to its back center position. The geneva motion holds the transmission stationary until the reengagement of the pinion 33 and the segment gear 28 takes place at the proper time after reversal takes place. At this time the output shaft 32 is rotated in a clockwise direction (as viewed from the front of the loom). A similar movement of the drive sprocket 26 takes place and moves the belt 19, so that the upper run 21 moves to the right and the lower run 22 moves to the left. As best seen in FIG. 2, the movement of the upper run 21 of the belt to the right carries the finger 45 and the block 47 with it, so that it slides along the shaft 46 and carries the rapier 13 to the right. Similarly, the left-hand movement of the lower run 22 of the belt carries the finger 44 and the block 42, so that the rapier 12 moves to the left.

Eventually, the lay 53 reaches the forward point of its movement and so the gear segment 28 has moved rearwardly as far as necessary to cause disengagement with the pinion as the rapiers reach a point just outside of the shed (outside of the width of the cloth to be formed) and the geneva mechanism engagement between the cam 51 and the cam guide 52 causes a dwell to take place. The gear segment 28 continues to move rearwardly, but the pinion gear 33, the input shaft 31, the output shaft 32, and its drive pinion 26 do not rotate, so that the belt 19 remains fixed in a dwell mode. The lay sword 15 continues to move forwardly to front center and then begins its rearward motion. Rotation of the crank shaft 17 then starts the movement of the lay sword 15 toward the rear, which causes a forward motion of the gear segment 28 and reverses the action of the transmission. At point of contact of pinion tooth and gear segment tooth the geneva motion 34 is free and allows gear meshing to take place, so that the belt 19 begins to move in the other direction, while the lower run 22 moves to the right and the rapiers 12 and 13 move together. The rapiers 12 and 13 move together and eventually meet in the center of the fabric shed at crank shaft 17 back center position and transfer the weft from one to the other. The lay sword then reverses and starts its forward motion, so that the rapiers move apart, completing the travel of the weft across the shed. In general, then, during the last portion of the forward motion of the lay sword 15, when the weft is being beaten, the rapiers 12 and 13 reside outside of the shed and are picking up the weft, the dwell portion of the cycle taking place at that time. In this way, it is possible to fasten the end of the weft to the proper rapier without doing it "on the fly". The fact that the rapier is not moving while the weft is being attached, means that the weft attachment mechanism can be quite simple. Furthermore, the fact that the rapiers do not continue to move during the last part of the beating up of the weft means that the travel of the rapiers can be considerably less than would otherwise be the case, so that for a given loom frame, a wider cloth can be woven. It can be seen that from the nature of the mechanism, there is very little noise involved in moving the rapiers back and forth. This is particularly true because of the fact that the belt 19 which, in the preferred embodiment, is in the form of a timing belt.

The use of a timing belt, which is made of a polymer, such as Teflon, reinforced by fabric and metal mesh, means that the power transmission to the rapiers takes place with little noise and with a small absorption of power. The fact that the apparatus has low inertia (because of its light weight) means that the increase in acceleration (that is necessary to speed up the loom) can take place with very little extra power. Particularly, when the apparatus is used in converting a shuttle-type loom to a rapier-type loom, the motor that is available on the original loom is perfectly adequate to operate the present mechanism. The fact that the equipment is light weight, particularly in the area of the belt, means that the reversal of motion can take place without shock to the machine and this lack of shock shows up well in the quality of the cloth produced. The balanced nature of the parts also contributes to this lack of shock at the reversal point. The use of the dwell or hesitation in the cycle allows the rapiers to be located close to the edges of the cloth web with the resultant advantages thereof. As the lay moves rearward, the rapiers do not move until geneva motion allows engagement of pinion and segment gear. If it were necessary to drive the rapiers continuously, as is done with present constructions and designs, one would then be forced to move the rapiers well outside of the web a substantial distance. The disadvantages of this are that first of all, one must use a weft yarn that is too long, one must provide a machine that is too wide, and, furthermore, one loses control of the weft, which gives a variation in the cloth shading and color and etc. As was said before, the hesitation in the rapier movement also allows a simpler yarn pickup and transfer system. Nevertheless, the present drive mechanism can be used with the older rapier transfer systems. Furthermore, using the same horizontal pivot line for both the lay sword and the rocker arm 27 which carries the gear segment, means that it is only necessary to adjust the radius of the drive segment in order to synchronize the lay and the rapiers, since they operate on concentric circles.

The bell crank 36 uses the cam shaft 16 as its bearing. The greatest forces of the drive mechanism are transmitted thru this bell crank and the cam shaft (the nearest and best supported moving member in the loom) and this eliminates the need of an additional heavy bearing bracket for the bell crank. Also, space would limit its best design. Designers do not ordinarily use turning shafts as bearing surfaces; however, a reciprocating member of any machine poses a wear problem on its mount that is greater than in the case of a rotating member. Therefore, if a heavy-loaded reciprocating member uses a strong rotating shaft for its bearing, one obtains the full rotating action of a turning shaft in a bearing with the reciprocating member, because a hydrodynamic layer of lubricant is maintained by the rotating shaft.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Rapier drive mechanism for a textile loom, having a reciprocating lay, a lay sword rocker shaft, and having a pair of transversely-slidable rapiers capable of movement for transferring weft yard from side-to-side of the loom, comprising:

(a) a right angle transmission mounted on the loom lay with an input shaft whose axis extends transversely of the loom and with an output shaft whose axis is transverse to the axis of the input shaft, the input shaft having a pinion gear, the transmission including a geneva device that causes the output shaft to dwell, (b) connecting means operatively connected to the output shaft and to each of the rapiers, so that rotation of the output shaft in one direction moves the rapiers toward one another and rotation of the output shaft in the other direction moves the rapiers apart, and (c) operating means including a rocker arm that is mounted at one end on the lay sword rocker shaft for swinging movement and having a gear segment mounted at the other end for engaging and driving the pinion gear on the input shaft to bring about alternative rotation of the output shaft through a cycle that includes rotation of the output shaft in one direction to move the rapiers toward one another, rotation of the output shaft in the other direction to move the rapiers apart, and a substantial dwell after the rapiers have moved to the position at which they are furthest apart and before beginning the next cycle, the cycle taking place in the same period of time as a lay reciprocating cycle.

2. Rapier drive mechanism as recited in claim 1, wherein a connection joins the lay sword to the said rocker arm to cause opposite movement of the sword and arm, the connection consisting of a bell crank having a bearing rotatably carried on the rotating bottom shaft, the crank having one portion whose end is connected by a rod to the lay sword and another portion whose end is connected by a rod to the rocker arm.

3. Rapier drive mechanism as recited in claim 2, wherein the connection between the ends of the bell crank, on the one hand, and the rods to the lay sword on the rocker arm, on the other hand, are adjustable lengthwise of the bell crank.

4. Rapier drive mechanism as recited in claim 2, wherein each rapier is mounted in a block and the blocks are slidable by the transmission on a transverse rod which is fixedly mounted on the loom lay.

5. Rapier drive mechanism as recited in claim 2, wherein both rapiers are driven from a single drive mechanism, inertial forces of reversals being self-absorbed and balanced out.

* * * * *